US007093456B2

(12) United States Patent
Shoukyuu et al.

(10) Patent No.: US 7,093,456 B2
(45) Date of Patent: Aug. 22, 2006

(54) DRIVE DEVICE OF AUTOMATIC ICE MACHINE

(75) Inventors: Masatoshi Shoukyuu, Kusatsu (JP); Ichiro Onishi, Koka-gun (JP)

(73) Assignee: Matsushita Electric Industrial Co. Ltd., Osaka (JP)

( * ) Notice: Subject to any disclaimer, the term of this patent is extended or adjusted under 35 U.S.C. 154(b) by 111 days.

(21) Appl. No.: 11/012,534

(22) Filed: Dec. 15, 2004

(65) Prior Publication Data

US 2005/0138950 A1 Jun. 30, 2005

(30) Foreign Application Priority Data

Dec. 22, 2003 (JP) ..... 2003-424168

(51) Int. Cl.
*F25C 5/02* (2006.01)

(52) U.S. Cl. ..... 62/320; 241/DIG. 17

(58) Field of Classification Search ..... 62/320; 241/DIG. 17
See application file for complete search history.

(56) References Cited

U.S. PATENT DOCUMENTS 3,135,101 A * 6/1964 Nigro ..... 62/344
3,159,986 A * 12/1964 King ..... 62/354
4,745,773 A * 5/1988 Ando ..... 62/320
5,947,342 A * 9/1999 Song ..... 222/413

FOREIGN PATENT DOCUMENTS

JP 2001-272146 10/2001

* cited by examiner

*Primary Examiner*—William E. Tapolcai
(74) *Attorney, Agent, or Firm*—RatnerPrestia

(57) ABSTRACT

A drive device of an automatic ice machine turns over an ice tray in which ice has been made. This is done to separate the ice. The drive device includes a motor, a first output shaft and a second output shaft having positional relation of mutually crossing, and a reduction gear for reducing rotation of the motor and transmitting respectively different driving forces to the first output shaft and the second output shaft. The second output shaft crushes ice, and the first output shaft separates ice from the ice tray. In this manner the ice is made rocky without roundness.

10 Claims, 4 Drawing Sheets

DRIVE DEVICE OF AUTOMATIC ICE MACHINE

FIELD OF THE INVENTION

This invention relates to a drive device of an automatic ice machine mounted in a domestic electric refrigerator, and automatically making ice and storing the same.

BACKGROUND OF THE INVENTION

A drive device of an automatic ice machine mounted in a domestic electric refrigerator disclosed in Patent Laid Open 2001-272146 automatically supplies water on an ice tray disposed in a refrigeration room, and after frozen, discharges ice from the ice tray by the drive device.

FIG. 6 is a plan view showing the drive device of an existing automatic ice machine. The existing device is composed of (i) ice tray 1 of storing water and making ice, (ii) a plurality of fixing fingers 2 making fixed rows on the upper face of ice tray 1, (iii) moving pawls 3 rotating by a motor (not shown) and discharging ice, (iv) stop arm 4 of detecting an amount of ice storing in an ice box (not shown), and (v) control box 5 of working moving pawls 3 and stop arm 4.

Ice tray 1 includes a thermister and a heater. When water in ice tray 1 is frozen, and the thermister detects completion of making ice, the heater is electrically conducted. When ice begins melting at an ice surface contacting ice tray 1, the electric conduction to heater 1 is finished, and subsequently the conduction to the motor begins. When moving pawl 3 is rotated 360° by rotation of the motor, ice in ice tray 1 is discharged. The discharged ice is sent to the ice box. After moving pawls 3 are rotated 360°, ice tray 1 is supplied with water, and again the ice making work is started. The above work is repeated until stop arm 4 detects predetermined amount of ice.

However, in the drive device of the existing automatic ice machine, since ice is easily removed from the ice tray, ice shapes are uniformly rounded. Less round and rock like ice cannot be made, which is demanded by consumers.

SUMMARY OF THE INVENTION

In view of the above problem, the invention is to provide the drive device of the automatic ice machine which makes rocky ice.

For solving the existing problem, the drive device of the automatic ice machine of the invention is composed of a motor, a first output shaft and a second output shaft having a positional relation of mutually crossing, and a reduction gear which reduces rotation of the motor and transmits respectively different driving forces to the first output shaft and the second output shaft, and crushes ice with the second output shaft, rotates the ice tray by the first output shaft, and separates crushed ice from the ice tray. Since ice is crushed by the second output shaft, ice will be less round and rocky.

DETAILED DESCRIPTION OF THE EXEMPLARY EMBODIMENTS

In the following description, explanation will be made to the embodiment of the drive device of the automatic ice machine according to the invention in reference to the drawings. The invention is not limited to this embodiment.

(Embodiment 1)

Figure 1:
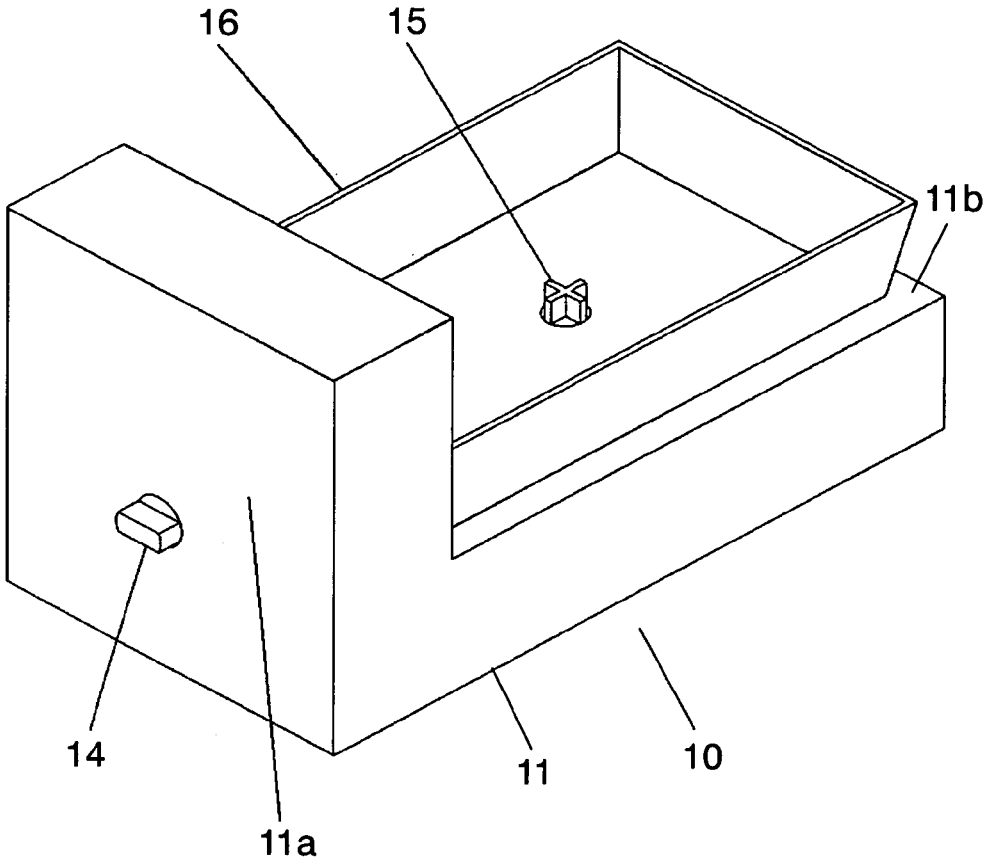
FIG. 1 is a perspective view of the drive device of the automatic ice machine in an embodiment of the invention.
Figure 2:
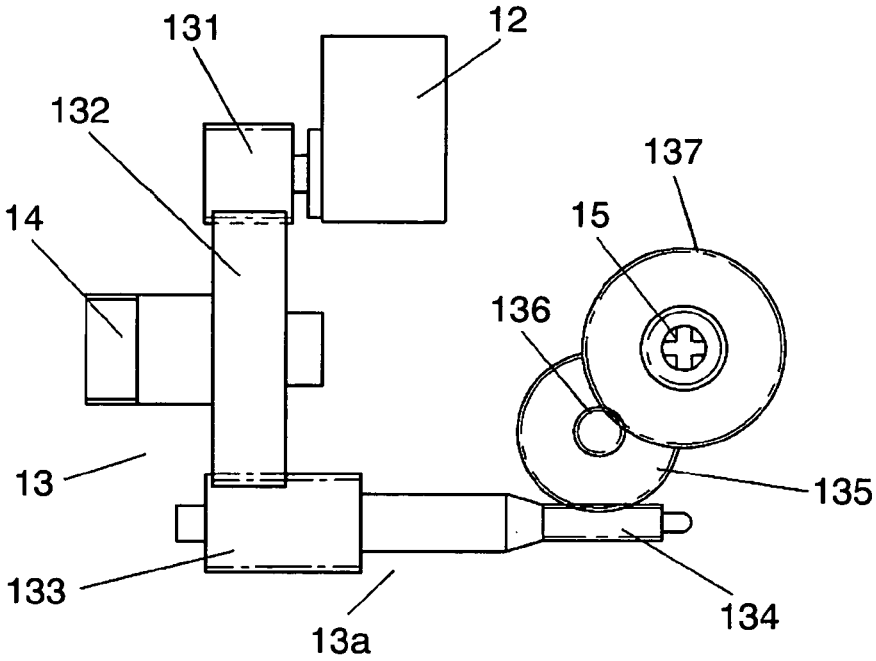
FIG. 2 is a plan view showing a gear arrangement in the same embodiment.
Figure 3:
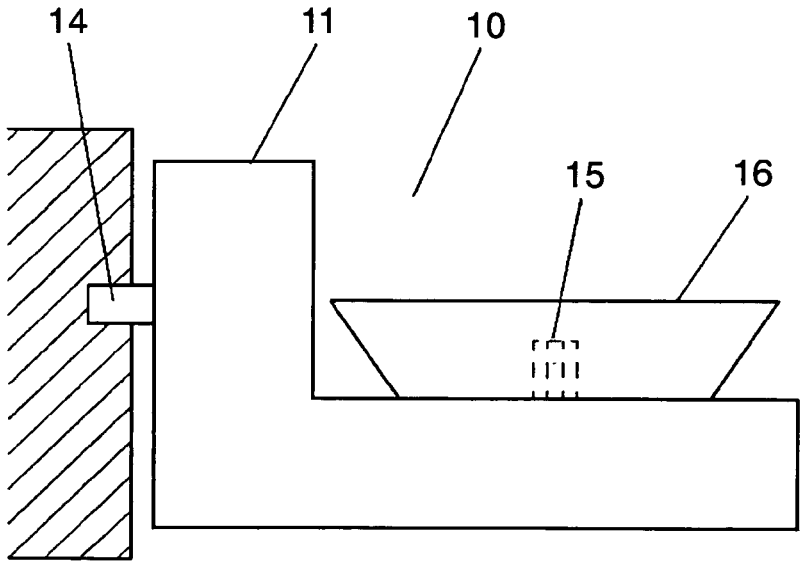
FIG. 3 is a partially cross sectional view showing attaching conditions of the drive device in the same embodiment.

FIG. 1 is the perspective view of the drive device of the automatic ice machine in the embodiment of the invention. FIG. 2 is the plan view showing the gear arrangement in the same embodiment. FIG. 3 is the partially cross sectional view showing the attaching conditions of the drive device in the same embodiment.

In FIGS. 1 and 2, drive device 10 accommodates therein motor 12 and reduction gear train 13 in case 11 of L shape in cross section.

First output shaft 14 projects horizontally from vertical wall 11*a* of case 11. Second output shaft 15 projects vertically from horizontal wall 11*b* of case 1. Both of first output shaft 14 and second output shaft 15 are driven by gear train 13. Second output shaft 15 is formed at a front end in cross (+) shape. Gear train 13 includes pinion gear 131, first output gear 132, gear 133, worm gear 134, worm wheel gear 135, gear 136, and second output gear 137. Motor 12 drives pinion gear 131. First output gear 132 is provided as one body with first output shaft 14, while second output gear 137 is provided as one body with second output shaft 15.

Since first output shaft 14 and second output shaft 15 have a positional relation of mutually crossing, reduction gear 13 transmits rotation running around an axis of a horizontal direction to first output shaft 14, and transmits rotation around the axis of a vertical direction to second output shaft 15. The gear train is so composed as to change the rotating direction by 90°. In the embodiment, gear 133 and worm gear 134 are coaxially formed as one body, and compose double reduction gear 13*a*. Since gear 133 is disposed inside of vertical wall 11*a* of case 11, and worm gear 134 is disposed inside of horizontal wall 11*b* of case 11, the rotating directions of gear train 13 are different by 90° with respect to the side of vertical wall 11*a* and the side of horizontal wall 11*b* of case 11.

In gear train 13, reduction gear ratio until a first output gear and reduction gear ratio until a second output gear are different. Specifically, the second output gear is set to be sufficiently slow in rotating in comparison with the first output gear. In the embodiment, while the first output gear rotates 180°, the second output gear rotates about 5°.

Ice tray 16 is disposed on the horizontal surface of case 11 to encircle second output shaft 15. When supplying water into ice tray 16, second output shaft 15 is buried in water, leaving a little part of a front end thereof.

As shown in FIG. 3, in the embodiment, since first output shaft 14 is secured to the wall within the refrigerator, by driving first output shaft 14, drive device 10 and ice tray 16 are rotated.

In regard to the drive device of the automatic ice machine structured as above, the actuation thereof will be explained.

When ice tray 16 is supplied with a proper quantity of water and the ice-making is completed, a controller (not shown) rotates motor 12. The rotation of motor 12 is transmitted to first output shaft 14 and second output shaft 15 through gear train 13. Since first output shaft 14 is secured to the wall within the refrigerator, by driving first output shaft 14, drive device 10 and ice tray 16 start rotation.

Reduction gear ratio from the motor 12 until the second output gear 137 is larger than reduction gear ratio from the motor 12 until the first output gear 132. Specifically, when first output gear 132 rotates 180°, that is, when drive device 10 and ice tray 16 turn over 180°, second output gear 137 rotates about 5°.

Second output shaft 15 is blocked from rotation by ice, but the second output gear rotates at torque exceeding this blocking, so that ice is crushed by second output gear 137. Ice is then broken into irregularly polygons, becomes so-called rocky, and is stored in the ice box under ice tray 16.

It has been confirmed by applicant's experiments that by making a shape of second output shaft 15 cross (+), ice is broken into four pieces.

The cross sectional shape of second output shaft 15 is not limited to the cross (+), but shapes sufficient to break ice by rotation, for example, a Y shape will do.

(Embodiment 2)

Figure 4:
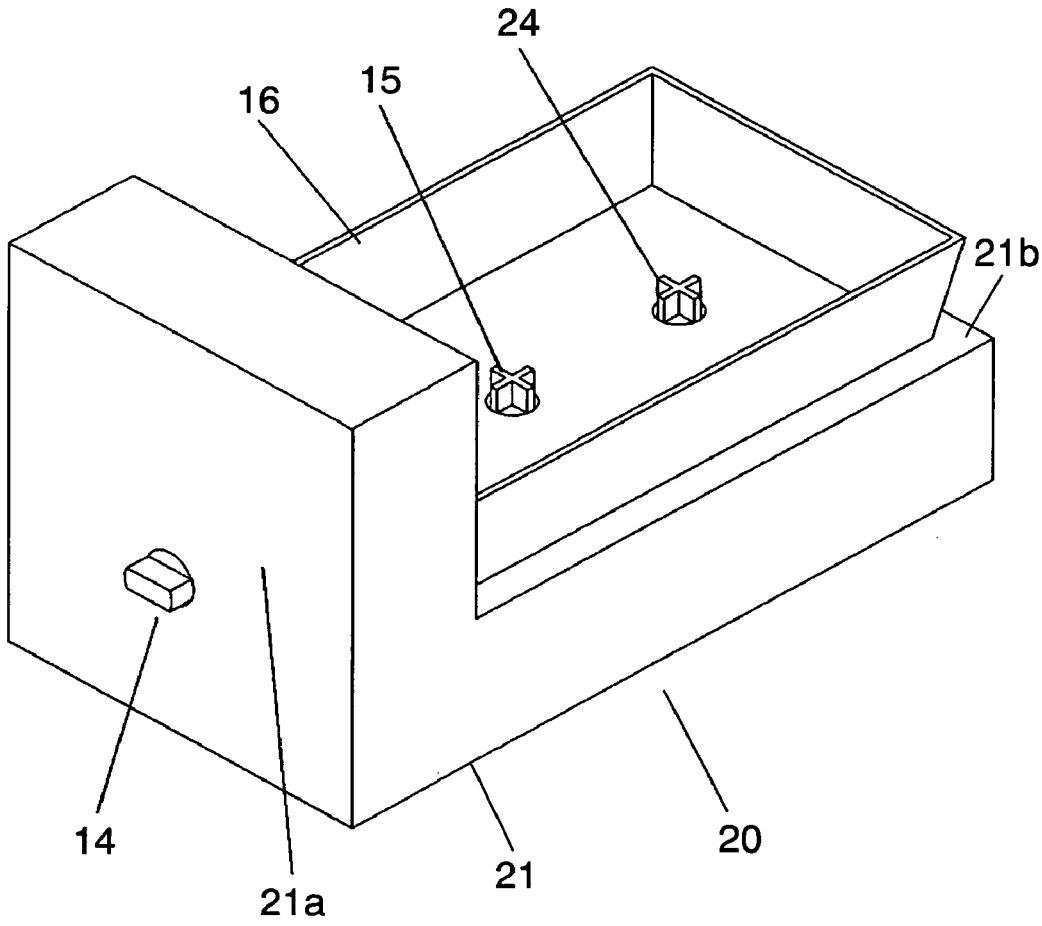
FIG. 4 is a perspective view of the drive device of the automatic ice machine in an another embodiment of the invention.
Figure 5:
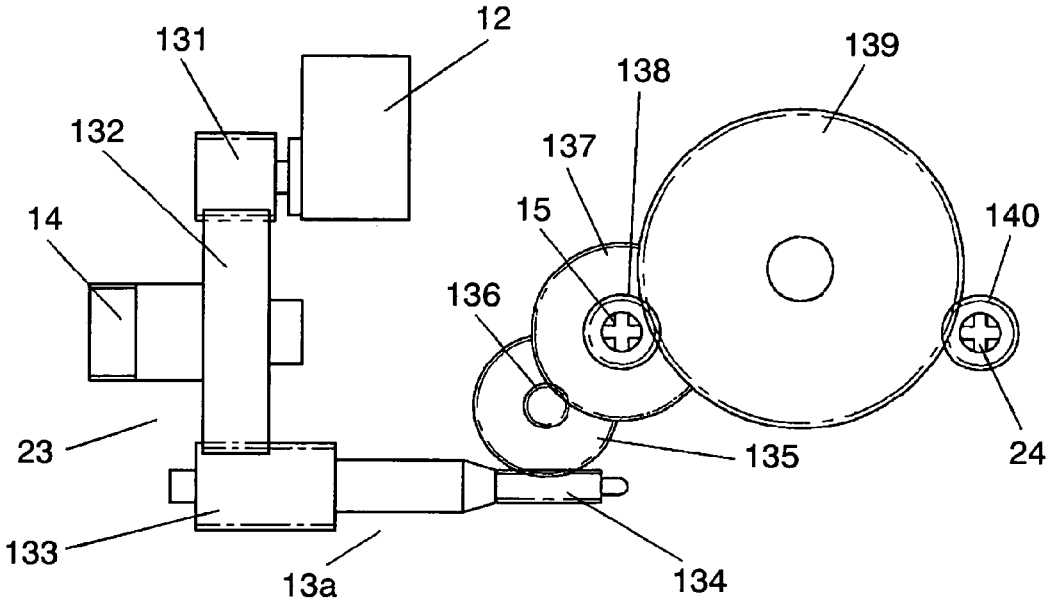
FIG. 5 is a plan view showing the gear arrangement in the same embodiment.
Figure 6:
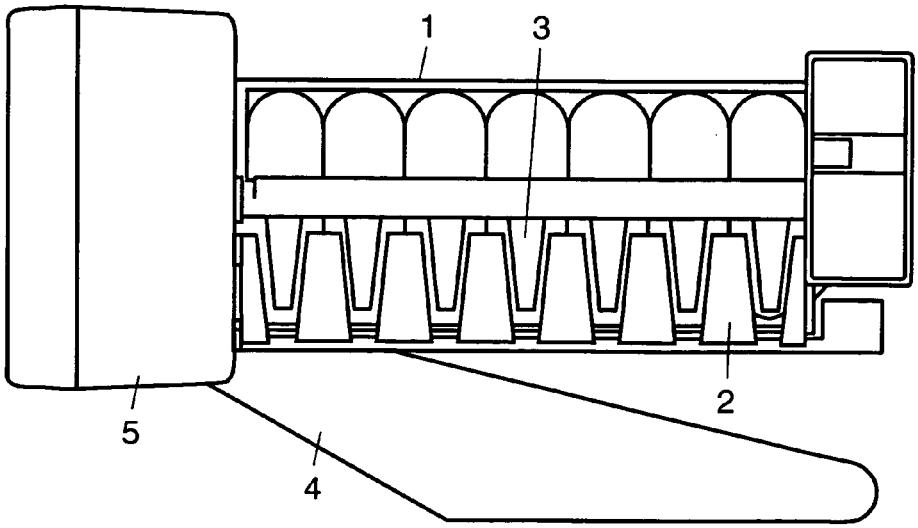
FIG. 6 PRIOR ART
FIG. 6 is a plan view showing the drive device of the existing automatic ice machine.

FIG. 4 is the perspective view of the drive device of the automatic ice machine in the embodiment 2 of the invention. FIG. 5 is the plan view showing the gear arrangement in the same embodiment. Parts of performing the same works of the embodiment 1 will be given the same numerals and detailed reference will be omitted.

In FIGS. 4 and 5, drive device 20 accommodates therein motor 12 as a drive source and reduction gear train 23 in case 21 of L shape in cross section.

First output shaft 14 projects horizontally from vertical wall 21*a* of case 21. Second output shaft 15 and third output shaft 24 project vertically upward from horizontal wall 21*b* of case 21. First output shaft 14, second output shaft 15 and third output shaft 24 are all driven by reduction gear train 23. Second output shaft 15 and third output shaft 24 are formed at front ends in cross (+) shape. Reduction gear train 23 includes pinion gear 131, first output gear 132, gear 133, worm gear 134, worm wheel gear 135, gear 136, second output gear 137, gear 138, transmission gear 139, and third output gear 140. Motor 12 drives pinion gear 131.

First output gear 132 is provided as one body with first output shaft 14, second output gear 137 is provided as one body with second output shaft 15, and third output gear 140 is provided as one body with third output shaft 24.

Ice tray 16 is disposed on the horizontal surface of case 21 to encircle second output shaft 15 and third output shaft 24. When supplying water into ice tray 16, second output shaft 15 and third output shaft 24 are buried in water leaving a little part of each of their front ends.

In regard to the drive device of the automatic ice machine structured as above, the actuation thereof will be explained.

When water supplied in ice tray 16 is frozen and the ice-making is completed, the controller (not shown) rotates motor 12. Rotation of motor 12 is transmitted to first output shaft 14, second output shaft 15 and third output shaft 24 through reduction gear train 23. Since first output shaft 14 is secured to the wall within the refrigerator, by driving first output shaft 14, drive device 20 and ice tray 16 rotate.

Reduction gear ratios from motor 12 until second output gear 137 and third output gear 138 are larger than reduction gear ratio from motor 12 until first output gear 132. When first output gear 132 rotates 180°, that is, when drive device 20 and ice tray 16 rotate 180°, second output gear 137 and third output gear 138 rotate about 5°.

Second output shaft 15 and third output shaft 24 are blocked from rotation by ice, but second output shaft 15 and third output shaft 24 rotate at torque exceeding this blocking, so that ice is crushed. Ice is then broken into irregular polygons, becomes so-called rocky, and is stored in the ice box under ice tray 16.

In this embodiment, two output shafts for breaking ice are provided, so that shearing force efficiently exerts on ice interposed between shafts, and ice is easily cracked. Accordingly, with more output shafts, ice is more easily broken.

It has been confirmed by the applicant's experiments that by making the shapes of second output shaft 15 and third output shaft 24 cross (+), and rotating second output gear 137 and third output gear 138 in the same direction, ice is broken into six pieces.

The cross sectional shape of second output shaft 15 and third output shaft 24 are not limited to the cross (+), but shapes sufficient to break ice by rotation, for example, a Y shape will do. Rotation is not always performed in the same direction.

As having mentioned above, the drive device of the automatic ice machine according to the invention has the structure of turning over the ice tray in which ice has been made by the first output shaft and crushing ice by the second output shaft, so that it is possible to offer less round and rock like ice, which satisfies needs of consumers.

The drive device may be structured to drive at least two output shafts with one motor, and is at low cost.

What is claimed is:

1. A drive device of an automatic ice machine of turning over an ice tray in which ice has been made to separate ice, comprising a motor;

a first output shaft and a second output shaft having positional relation of mutually crossing; and a reduction gear of reducing rotation of the motor and transmitting respectively different driving forces to the first output shaft and the second output shaft, wherein the second output shaft crushes ice, and the first output shaft rotates the ice tray to separate ice.

2. A drive device of an automatic ice machine as set forth in claim 1, wherein the motor is one, the first output shaft is fixed to a fixing portion of the ice machine, and the second output shaft projects inside of the ice tray.

3. A drive device of an automatic ice machine as set forth in claim 2, wherein reduction gear ratio from the motor until the second output shaft is larger than reduction gear ratio from the motor until the first output shaft.

4. A drive device of an automatic ice machine as set forth in claim 2, wherein a cross section of the second output shaft is shaped in cross (+).

5. A drive device of an automatic ice machine as set forth in claim 1, wherein a gear group composing the reduction gear has a gear of changing 90° the direction of a rotating shaft.

6. A drive device of an automatic ice machine as set forth in claim 1, wherein the reduction gear has a double reduction gear of two gears being formed coaxially as one body, and the double reduction gear is provided at one side with a worm gear.

7. A drive device of an automatic ice machine as set forth in claim 6, wherein the worm gear is disposed at the side of second output shaft.

8. A drive device of an automatic ice machine as set forth in claim 2, wherein the second output shafts are plural.

9. A drive device of an automatic ice machine as set forth in claim 8, wherein the plurality of second output shafts rotate in the same direction.

10. A drive device of an automatic ice machine as set forth in claim 8, wherein reduction gear ratio from the motor until the plurality of second output shafts is larger than reduction gear ratio from the motor until the first output shaft.

* * * * *